US006485099B2

(12) United States Patent
Illulian

(10) Patent No.: US 6,485,099 B2
(45) Date of Patent: Nov. 26, 2002

(54) REVERSIBLE SLIPCOVER

(75) Inventor: David Illulian, Beverly Hills, CA (US)

(73) Assignee: Classic Slipcovers Inc., Vernon, CA (US)

( * ) Notice: Subject to any disclaimer, the term of this patent is extended or adjusted under 35 U.S.C. 154(b) by 0 days.

(21) Appl. No.: 10/046,524

(22) Filed: Jan. 14, 2002

(65) Prior Publication Data

US 2002/0063454 A1 May 30, 2002

Related U.S. Application Data

(62) Division of application No. 09/650,509, filed on Aug. 29, 2000, now Pat. No. 6,398,301.

(51) Int. Cl.[7] ..... A47C 31/00
(52) U.S. Cl. ..... 297/228.12
(58) Field of Search ..... 297/219.1, 223, 297/228.12, 225, 228, 229, 218.1, 228.1

(56) References Cited

U.S. PATENT DOCUMENTS 1,964,242 A * 6/1934 Behrle
2,367,450 A * 1/1945 Trubitz
3,109,474 A * 11/1963 Levi
3,695,691 A * 10/1972 Putnam
5,320,407 A * 6/1994 Tell
5,611,595 A * 3/1997 Gatehouse
5,690,380 A * 11/1997 Waters

* cited by examiner

*Primary Examiner*—Milton Nelson, Jr.
(74) *Attorney, Agent, or Firm*—Notaro & Michalos P.C.

(57) ABSTRACT

A semi-fitted furniture slipcover arrangement covers a piece of seating furniture, the piece of furniture having a back, at least one arm, a seat and a body. The arrangement includes a reversible slipcover made of reversible fabric having opposite first and second surfaces which are visually different from each other and which are both adapted to face outwardly and be visible on the furniture. The slipcover has a back portion for covering a back surface of the furniture back of the furniture, an upper front portion connected to the back portion for covering a front surface of the furniture back, a seat portion connected to the upper front portion for covering the furniture seat, an arm portion connected to the back and seat portions, for covering the arm and a lower front portion connected to the seat and arm portions for covering the furniture body. The arrangement further includes a reversible gather mechanism, such as paired grommet holes and a tie line at the arm portion for gathering at least part of the fabric at the arm portion for closely fitting the arm portion over the arm. The gather mechanism is operable to gather at least part of the arm portion with either of the first or the second surfaces of the slipcover fabric facing toward the furniture.

8 Claims, 2 Drawing Sheets

REVERSIBLE SLIPCOVER

CROSS REFERENCE TO RELATED APPLICATION

This is a divisional of application Ser. No. 09/650,509, filed Aug. 29, 2000, now U.S. Pat. No. 6,398,301.

FIELD AND BACKGROUND OF THE INVENTION

The present invention relates in general to fabric slipcovers for covering furniture, and in particular, to a new and useful semi-fitted and reversible slipcover.

It is know to cover various pieces of seating furniture such as sofas, love seats and chairs, with fabric slipcovers. These slipcovers as usually custom cut and fitted by skilled workers and thus are quite expensive. If the owner of the furniture piece wishes to buy a different piece of furniture of the same style, the fitted cover of the older piece cannot be utilized for the most part, for the new piece, particularly if the new piece is larger than the old piece.

U.S. Pat. No. 5,549,355 discloses a slipcover having an elastic band stitched at selected positions along the inside of the cover such that when the cover is placed on a furniture piece, such as a sofa or chair, the cover takes the shape of the furniture piece, thus eliminating the time consuming and expensive steps which were required to fit a cover to the furniture piece.

U.S. Pat. No. 5,547,249 discloses a slipcover which is not fitted but which requires the use of stabilizing devices with the slipcover to shape it to the furniture piece.

A need remains for a versatile, semi-fitted slipcover which can be used on various shapes and sizes of seating furniture.

SUMMARY OF THE INVENTION

It is an object of the present invention to provide a versatile, reversible, semi-fitted slipcover that can be used with seating furniture of various sizes and shapes, and which has the added advantage of having both inner and outer surfaces finished and suitable to be seen so that the slipcover can be reversed. This allows the single slipcover to give at least two very different looks to many different pieces of furniture.

Accordingly, a object of the invention is to provide a semi-fitted furniture slipcover arrangement which can cover a piece of seating furniture, the piece of furniture having a back, at least one arm, a seat and a body. The arrangement includes a reversible slipcover made of reversible fabric having opposite first and second surfaces which are visually different from each other and which are both adapted to face outwardly and be visible on the furniture. The slipcover has a back portion for covering a back surface of the furniture back of the furniture, an upper front portion connected to the back portion for covering a front surface of the furniture back, a seat portion connected to the upper front portion for covering the furniture seat, an arm portion connected to the back and seat portions for covering the arm, and a lower front portion connected to the seat and arm portions for covering the furniture body. The arrangement further includes a reversible gather mechanism, such as paired grommet holes and a tie line at the arm portion for gathering at least part of the fabric at the arm portion for closely fitting the arm portion over the arm. The gather mechanism is operable to gather at least part of the arm portion with either of the first or the second surfaces of the slipcover fabric facing toward the furniture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
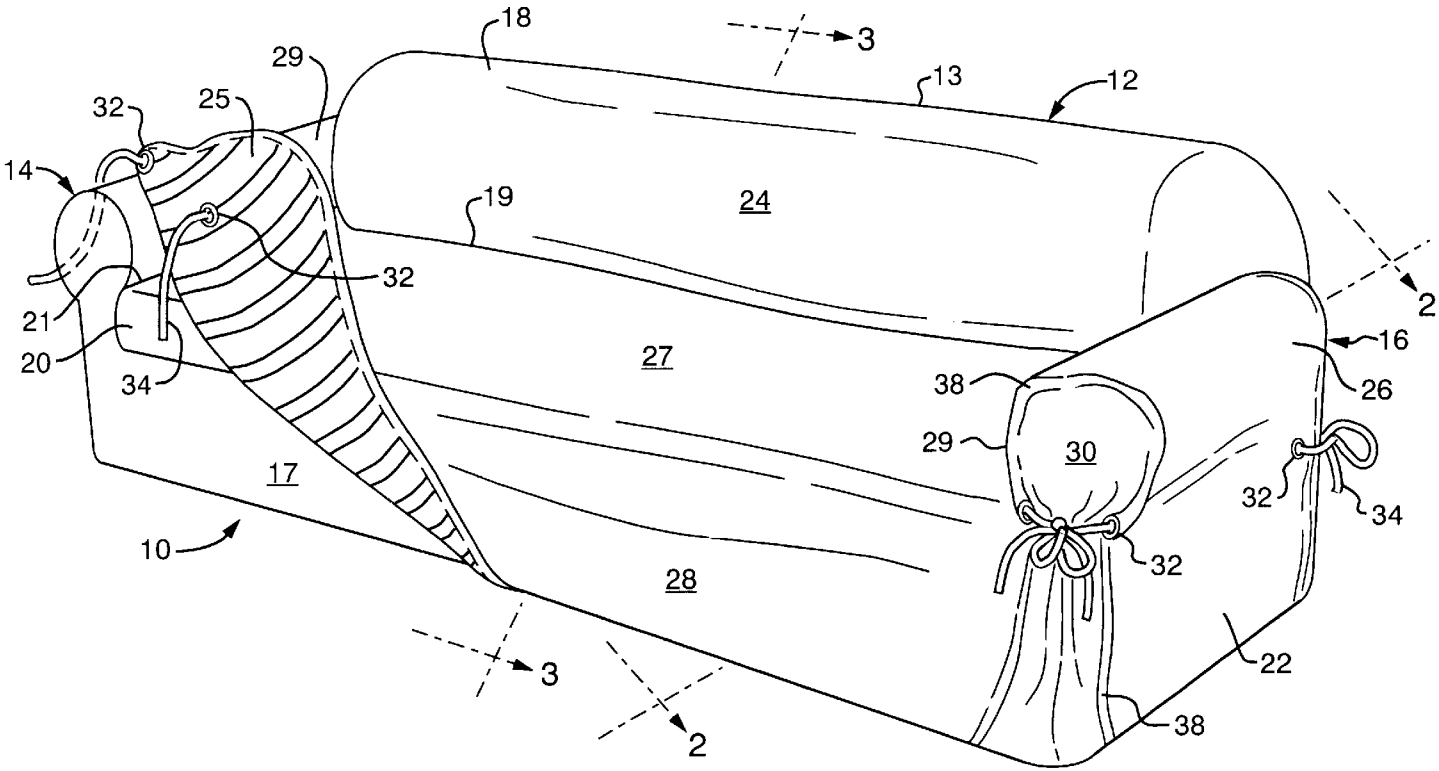
FIG. 1 is a perspective view of the reversible slipcover of the present invention, used on a sofa, and with a part folded up to expose a reversible inner surface of the slipcover.

Referring now to the drawings, the invention embodied therein, in FIG. 1, is a semi-fitted, reversible fabric slipcover generally designated 12, shown covering a piece of seating furniture, such as a sofa 10. Sofa 10 has arms or arm rests 14 and 16, a back 18, cushions or a seat area 20, and a lower body 17.

Figure 3:
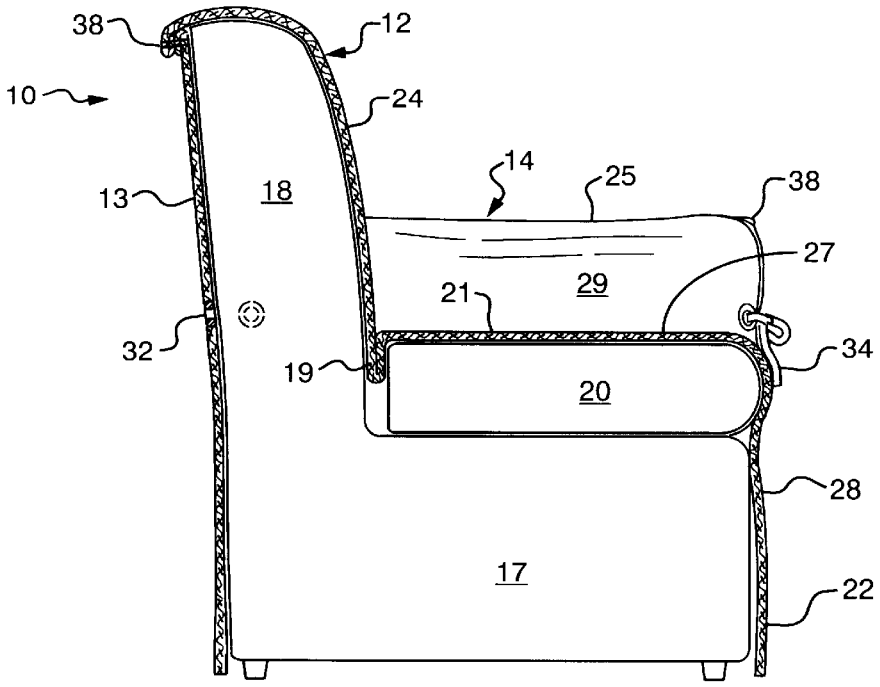
FIG. 3 is a sectional view of the slipcover taken along line 3—3 of FIG. 1.

A ruffle portion 22 of cover 12 forms a dust ruffle around the lower parts of sofa body 17. Cover 12 has a back portion 13 which extends in an essentially vertical direction to cover a back surface of the back 18 of the sofa 10, and an upper front portion 24 which comes up over, and covers a front surface of sofa back 18 as shown in FIG. 3. A pair of arm portions 25,26 of the slipcover 12 cover arms 14 and 16, a seat portion 27 covers the seat area and/or the cushions 20, and a lower front portion 28 extends downwardly in the vertical direction to cover the front surface of sofa body 17 and to form the dust ruffle 22 at the front of the seating furniture piece 10.

Arm portions 25 and 26 each have outer parts that extend down to cover the outer sides of the arms 14,26 and further down to form the dust ruffles 22 at the sides of the sofa. Each arm portion also has an inner part 29 that covers the inner surfaces of arms 14,16, and front parts 30 covering the front-of each arm.

Figure 4:
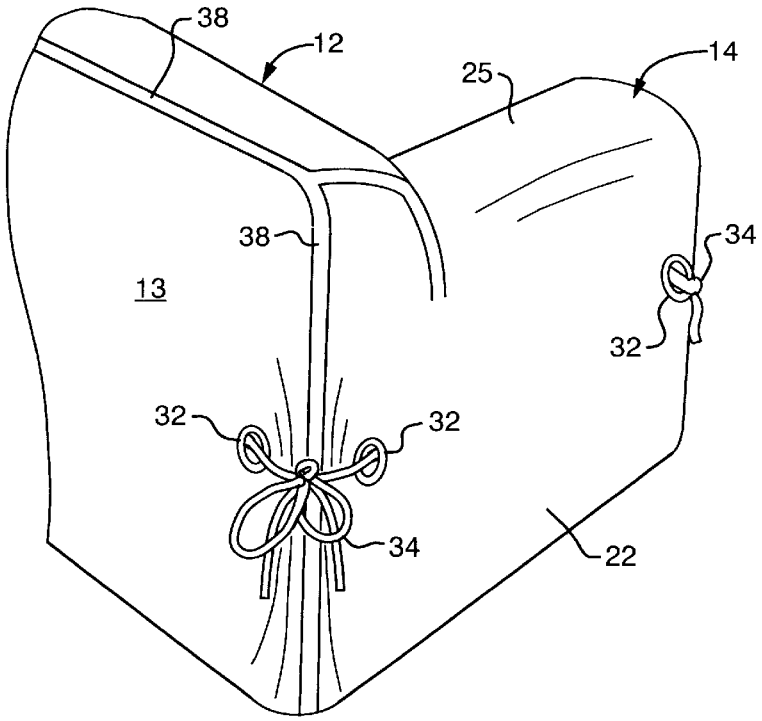
FIG. 4 is a partial perspective view of the slipcover and sofa of FIG. 1.

A pair of grommet-encircled, spaced apart holes 32 are provided in each arm portion, on opposite sided of each front part, near the level of the seat 20 of sofa 10. A line 34, such as a ribbon, string, cord or the like, passes through the pair of grommetted holes at the front of each arm portion, and is pulled and tied to gather some of the fabric of the front part together between the holes to better fit the arm portions 25,26 to their respective arms 14,16. This gather means is repeated at the rear of each arm portion as shown in FIG. 4. The pair of spaced holes 32 at the rear of slipcover 12 may include one hole on the side of the arm portion, and the other on the back portion 13, but with both holes being near the rear corner of the slipcover and sofa. The grommets may be brass or the like.

Extra fabric is provided for the slipcover 12 between the upper front portion 24 and the seat portion 27 so that this extra fabric can be tucked into a crease 19 between the sofa back 18 and seat area 20. Extra fabric is also provided between inner arm parts 29 and seat portion 27 for tucking into crease 21 between arms 14,16 and the seat area 20. This tucking of parts of the slipcover also helps form it more closely to the sofa shape and also resists the pulling of lines 34 to a closer fit all around.

FIG. 1 also illustrates the unique reversibility feature of the invention.

The reversible slipcover 12 is made of reversible fabric having opposite first and second surface which are visually different from each other and which are both adapted to face inwardly or outwardly. This is done by using a durable, single layer of fabric which can be printer on one or both sides. Both sides must be suitable to be seen, however. As shown in FIG. 1, the inner side of slipcover 12 is printed with a stripe pattern, this pattern being visible since part of the arm portion 25 over arm 14 has been lifted and turned in-side-out. The printing may also simply cover the selected surface with a solid contracting color from the color of the opposite side.

FIGS. 1 and 4 also show how the same lines 34, threaded into holes 32 from the opposite side, can be used to gather the arm portions, regardless of which surface faces outwardly. This is because the holes 32 extend through the fabric and the lines 34 can be threaded from either side of the slipcover.

It has been found that bull denim, which is 100% cotton or a cotton plus polyester blend, is suitable for the fabric of slipcover 12.

A preferred fabric is 100% carded, open-ended lightweight twill weave, bull denim. An example of the slipcover of the invention has been made from a formal construction of such fabric that is 58"×60", 7/1×9/1 with an average square yard weight of 9 oz. The fabric is first dyed a solid color and then printed on both sides using pigment dye stuffs that allow the fabric to be treaded on both sides and cured for permanency.

Other examples of the fabric may be 8 oz. to 10 oz./sq. yard, denim or square weave canvas, or other suitable material that can be revered for use with either surface facing outwardly.

Figure 2:
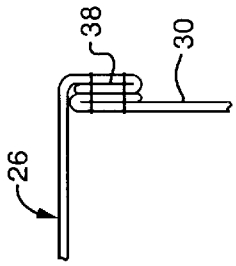
FIG. 2 is a sectional view of a seam used in the slipcover of FIG. 1, taken along line 2—2 of FIG. 1.

The seams must also be neatly made through-out the slipcover since these too must be presentable in either reversible position for the slipcover. FIG. 2 illustrates a rolled seam or bead seam 38 that is appropriate for use with the present invention. In this seam, the edge of each piece of fabric is folded onto itself and the two folded edges are overlapped, and sewn to each other by a pair of spaced apart parallel stitches as shown in FIG. 2. This type of seam exposes only its out fabric surface on each side of the slipcover and is finished looking so that the seams 38 are also reversible in nature, just as the gather means 32,34 and the two-sided fabric of the slipcover.

Although gather means in the form of reversible tie lines are illustrated, other gather means can be used, such as elastic fabric or parts at the arm portions.

While a specific embodiment of the invention has been shown and described in detail to illustrate the application of the principles of the invention, it will be understood that the invention may be embodied otherwise without departing from such principles.

What is claimed is:

1. A semi-fitted furniture slipcover arrangement for covering a piece of seating furniture, the piece of furniture having a back, at least one arm, a seat, and a body, the arrangement comprising:

a reversible slipcover made of reversible fabric having opposite first and second surfaces which are visually different from each other and which are both adapted to face outwardly and be visible on the furniture, the slipcover comprising;

a back portion for covering a back surface of the furniture back of the furniture;

an upper front portion connected to the back portion for covering a front surface of the furniture back;

a seat portion connected to the upper front portion for covering the furniture seat;

an arm portion connected to the back and seat portions, for covering the arm;

a lower front portion connected to the seat and arm portions for covering the furniture body; and the slipcover comprises a plurality of fabric parts that are sewn together by reversible seams that are overlapping material seams.

2. An arrangement according to claims 1, further including reversible gather means at the arm portion for gathering at least part of the arm portion for closely fitting the arm portion over the arm, the gather means being operable to gather at least part of the arm portion with either of the first or the second surfaces of the slipcover fabric facing the furniture.

3. An arrangement according to claim 2, including two spaced apart gather means respectively at a front and a rear of the arm portion for gathering fabric of the arm portion at the front of the arm portion, and for gathering fabric of the arm portion and the back portion, at the back of the arm portion.

4. An arrangement according to claim 1, wherein the fabric is printed on the first surface with a pattern or color that is different then a pattern or color of the opposite second surface.

5. An arrangement according to claim 1, wherein the gather means comprises a pair of spaced apart holes in the slipcover, and a line threaded into and between the holes and pulled to gather fabric of the slipcover between the holes.

6. An arrangement according to claim 1, wherein the fabric is bull denim.

7. An arrangement according to claim 1, wherein the fabric is canvas.

8. A semi-fitted furniture slipcover arrangement for covering a piece of seating furniture, the piece of furniture having a back, at least one arm, a seat, and a body, the arrangement comprising:

a reversible slipcover made of reversible fabric having opposite first and second surfaces which are visually different from each other and which are both adapted to face outwardly and be visible on the furniture, the slipcover comprising;

a back portion for covering a back surface of the furniture back of the furniture;

an upper front portion connected to the back portion for covering a front surface of the furniture back;

a seat portion connected to the upper front portion for covering the furniture seat;

an arm portion connected to the back and seat portions, for covering the arm;

a lower front portion connected to the seat and arm portions for covering the furniture body; and reversible gather means at the arm portion for gathering at least part of the arm portion for closely fitting the arm portion over the arm, the gather means being operable to gather at least part of the arm portion with each of the first or the second surfaces of the slipcover fabric facing the furniture.

* * * * *